US006160468A

United States Patent [19]

Himei

[11] Patent Number: 6,160,468

[45] Date of Patent: Dec. 12, 2000

[54] COIL BOBBIN

[75] Inventor: Hidekazu Himei, Tokyo, Japan

[73] Assignee: Mitsubishi Denki Kabushiki Kaisha, Tokyo, Japan

[21] Appl. No.: 09/439,081

[22] Filed: Nov. 12, 1999

[30] Foreign Application Priority Data

Jun. 8, 1999 [JP] Japan ..... 11-160643

[51] Int. Cl.[7] ..... H01F 27/30; H01F 27/04; H01R 13/44

[52] U.S. Cl. ..... 336/198; 336/107; 336/192; 439/131; 439/713

[58] Field of Search ..... 336/192, 198, 336/208, 107; 439/131, 713

[56] References Cited

U.S. PATENT DOCUMENTS 3,634,878 1/1972 Davis ..... 336/192

FOREIGN PATENT DOCUMENTS 3-204486 9/1991 Japan .
5-164263 6/1993 Japan .

*Primary Examiner*—Michael L. Gellner
*Assistant Examiner*—Anh Mai
*Attorney, Agent, or Firm*—Sughrue, Mion, Zinn, Macpeak & Seas, PLLC

[57] ABSTRACT

A coil bobbin includes a bobbin 1, around which a coil wire is wound, and a connector 2 for electrically connecting, wherein the bobbin 1 and the connector 2 are separate components, and a supporting hook 1*a* formed in the bobbin 1 is engaged with a rotating shaft of the connector 2*a* formed in the connector 2 so that the connector 2 is rotatable even after the bobbin 1 and the connector 2 are assembled, whereby a process of wiring can be stable, and various connector shapes can be adapted to the coil bobbin.

6 Claims, 7 Drawing Sheets

COIL BOBBIN

BACKGROUND OF THE INVENTION

1. Field of the Invention

The present invention relates to a coil bobbin, around which wires are would to form an electromagnetic solenoid.

2. Discussion of Background

A conventional technique in this technical field, for example as illustrated in FIG. 10, discloses a structure that a bobbin 11 includes a core 11*c* and flanges 11*d* provided on both ends of the core 11*c*, and terminals 12, 13 for electrically connecting are inserted into the bobbin in parallel with the core 11*c*. A coil wire 15 is wound by reciprocating a nozzle 14 between the widths of winding 11*a* of the bobbin 11. Therefore, a predetermined distance 11*b* or more is kept between the bobbin 11 and the terminals 12, 13 in winding the coil wire.

Because the conventional coil bobbin is constructed as such, it is necessary to keep the predetermined distance or more between the bobbin and the terminals, wherein there is a problem that miniaturization of a product is difficult. Further, because the nozzle is inserted into a winding portion in a direction parallel to the winding portion, a direction of the coil and a direction of the nozzle are perpendicular to cause tension at a portion, in which the coil wire is perpendicularly bent, wherein there is a problem that the tension is difficult to control.

Further, because the terminals are inserted into the bobbin, there is an economical problem such that another bobbin is required when a shape of connector is changed.

SUMMARY OF THE INVENTION

It is an object of the present invention to solve the above-mentioned problems inherent in the conventional technique and to provide a coil bobbin, in which a bobbin of winding a coil wire and a connector for connecting a lead wire of the coil are separate components so that a portion for engaging the bobbin with the connector is enabled to move; and the connector is moved on a side of a winding central axis of the bobbin so that a winding nozzle is arranged perpendicularly to a winding portion of the bobbin for bringing the connector to an outside of a movable range of the winding nozzle to thereby facilitate a control of the tension.

Another object of the present invention is to provide a coil bobbin, which can minimize the amount of looseness at a portion connecting the coil with the terminal, which looseness is caused by a movement of a movable connector in a direction perpendicular to a winding axis after completing winding by coaxially installing the portion for connecting the coil with the terminal and a rotating shaft of the movable connector.

Another object of the present invention is to provide a coil bobbin, which can be changed to various types by substituting only a detachable connector.

According to a first aspect of the present invention, there is provided a coil bobbin comprising: a bobbin having a core, around which a coil wire is wound; and a connector having a terminal, with which the coil wire is connected, which connector is detachably attached to the bobbin.

According to a second aspect of the present invention, there is provided a coil bobbin comprising: a bobbin having a supporting hook; and a connector having a rotating shaft, the rotating shaft is engaged with the supporting hook to joint the bobbin to the connector, wherein the connector is moved in a direction of a longitudinal axis of the bobbin at time of winding a coil, and the connector is moved in a direction perpendicular to the longitudinal axis of the bobbin after completing to wind the coil wire.

According to a third aspect of the present invention, there is provided a coil bobbin, in which a portion of the connector for jointing to the coil is provided in an axis being the same as the rotating shaft of the connector.

According to a fourth aspect of the present invention, there is provided a coil bobbin further comprising: a protrusion for thermally caulking, which protrusion fixes the connector to the bobbin.

According to a fifth aspect of the present invention, there is provided a coil bobbin further comprising: a hook for fixing the connector to the bobbin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein.

DETAILED DESCRIPTION OF THE PREFERRED EMBODIMENTS

A detailed explanation will be given of preferred embodiments of the present invention in reference to FIGS. 1 through 9 as follows, wherein the same numerical references are used for the same or similar portions and description of these portions is omitted.

Embodiment 1

Figure 1:
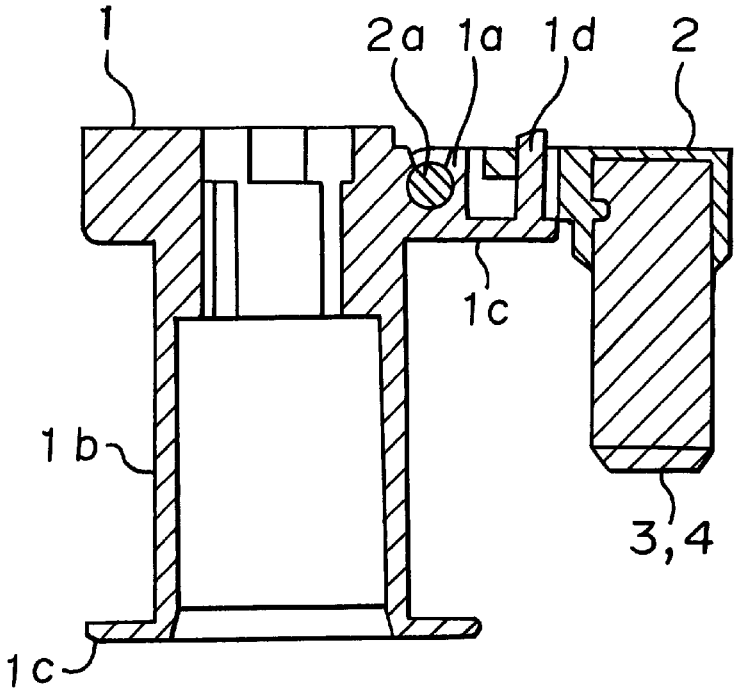
FIG. 1 is a front view schematically showing a coil bobbin according to Embodiment 1 of the present invention in section.
Figure 2:
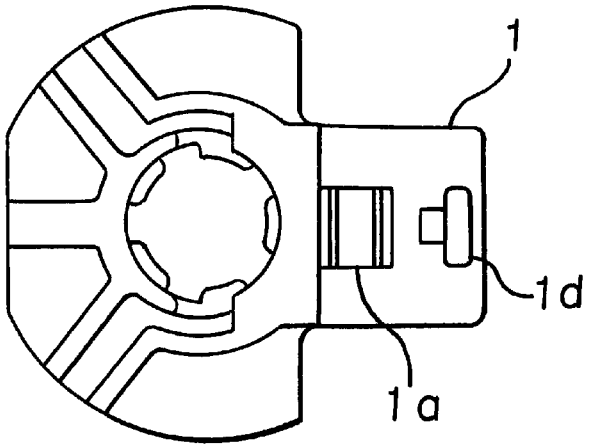
FIG. 2 is a plan view schematically illustrating a bobbin of the coil bobbin illustrated in FIG. 1.
Figure 3:
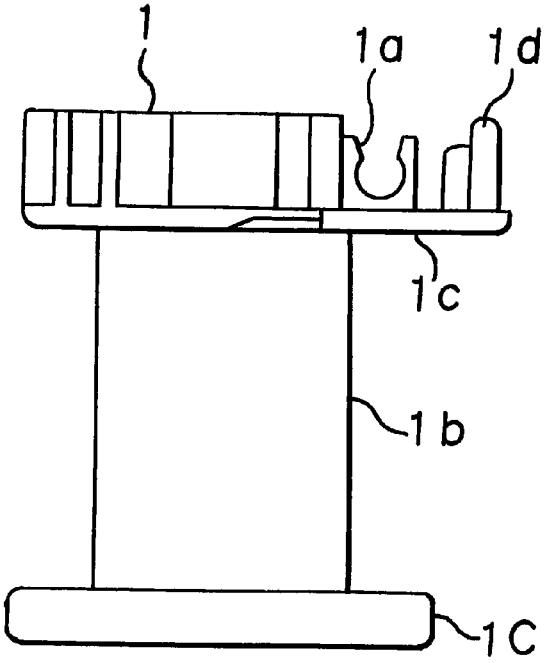
FIG. 3 is a front view schematically illustrating the bobbin of the coil bobbin illustrated in FIG. 1.
Figure 4:
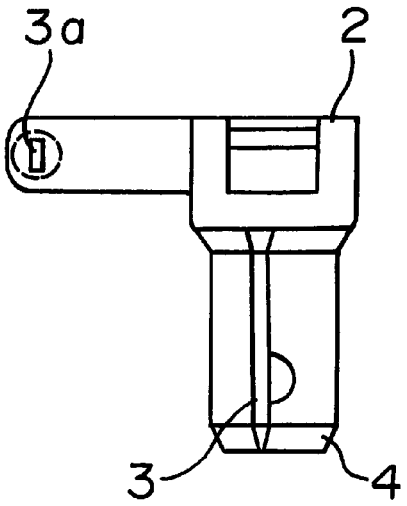
FIG. 4 is a front view schematically illustrating a connector illustrated in FIG. 1.
Figure 5:
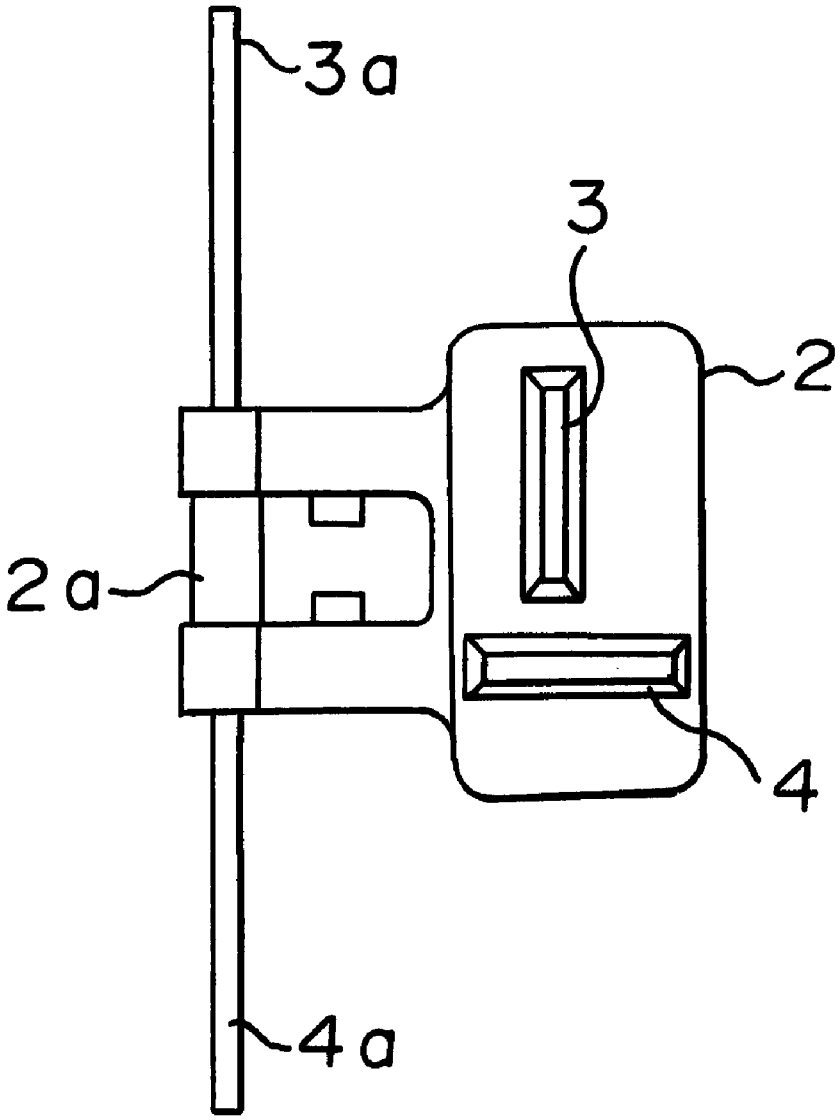
FIG. 5 is a plan view schematically illustrating the connector illustrated in FIG. 1.
Figure 6:
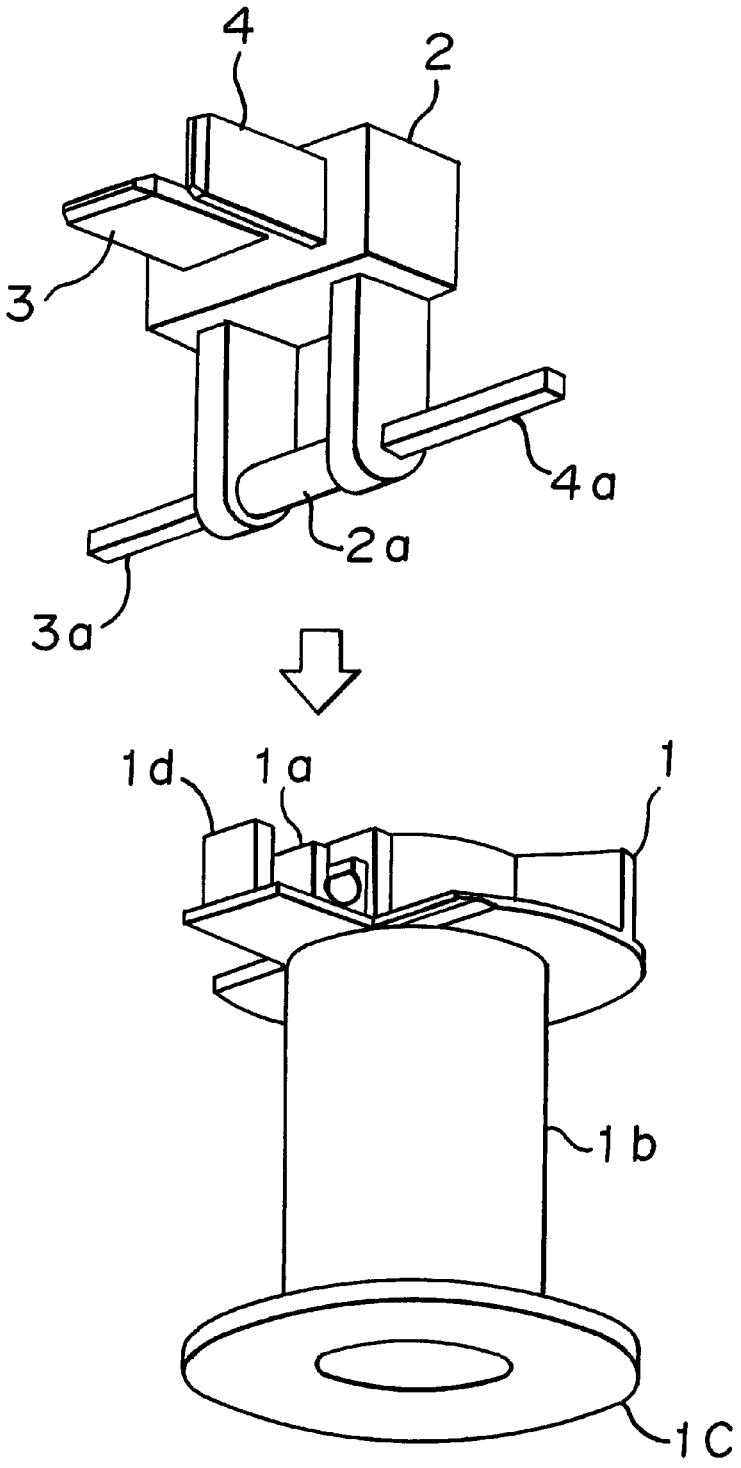
FIG. 6 is a perspective view illustrating the coil bobbin in a disassembled state according to Embodiment 1 of the present invention.
Figure 7:
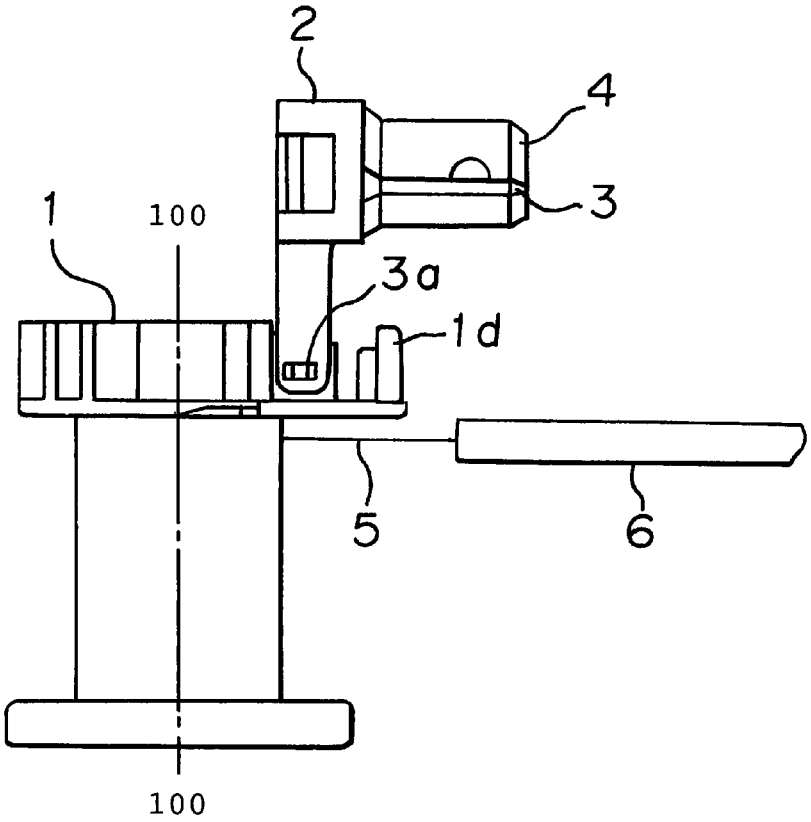
FIG. 7 is a front view schematically illustrating the coil bobbin according to Embodiment 1 of the present invention.
Figure 8:
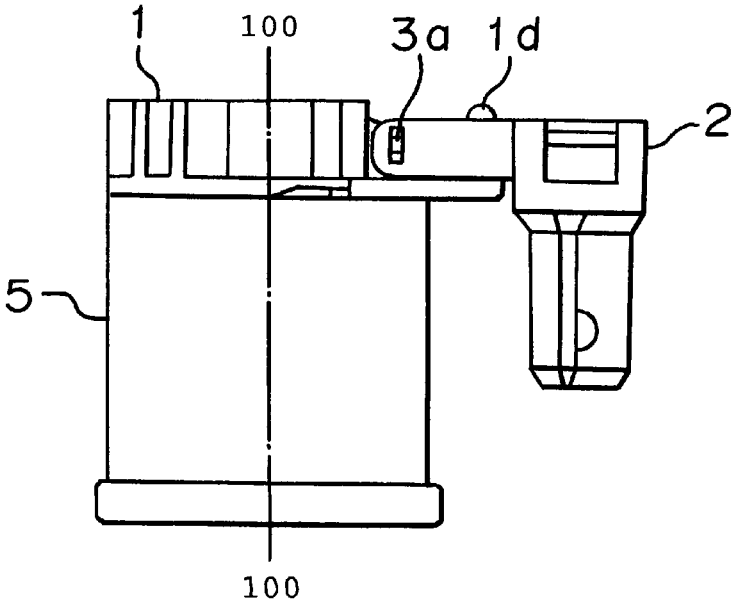
FIG. 8 is a front view schematically illustrating the coil bobbin according to Embodiment 1 of the present invention.

FIG. 1 is a front view illustrating a coil bobbin according to Embodiment 1 of the present invention in section. FIGS. 2 and 3 respectively are a plan view and a front view illustrating a bobbin. FIGS. 4 and 5 respectively are a front view and a plan view illustrating a connector. FIG. 6 is a perspective view illustrating the coil bobbin in a disassembled state. FIG. 7 is a front view of the coil bobbin at time of starting to wind a coil wire. FIG. 8 is a front view illustrating the coil bobbin at time of completing to wind the coil wire.

The coil bobbin according to Embodiment 1 is constructed by two components of a bobbin 1, being a winding portion, and a connector 2 for electrically connecting as in FIG. 4. As illustrated in FIG. 6, the bobbin 1 and the connector 2 are joined by engaging a hook 1*a* for supporting the bobbin 1 to a rotating shaft 2*a* of the connector 2.

The bobbin 1 is, for example, an independent part made of a resin, wherein the bobbin includes a core 1*b* as a winding portion, upper and lower flanges 1*c* provided on both ends of the core, a protrusion for thermally caulking which is provided in the upper flange to fix the connector 2, and a hook la for supporting the bobbin, being a portion for supporting to join to the movable connector.

On the other hand, the connector 2 includes terminals 3, 4 formed by inserting into the connector and a rotating shaft 2*a* engaged-with the hook for supporting bobbin 1*a*. By providing portions 3*a*, 4*a*, which are connected with the terminals 3, 4, and also connected with the coil wire 5, in an axis-same-as the rotating shaft 2*a*, looseness of the coil wire 5 is suppressed when the connector 2 is moved. Numerical reference 6 designates a nozzle for winding the coil wire 5 around the core 1*b*.

In the next, an operation will be described.

As illustrated in FIG. 7, at time of starting to wind the coil wire, the connector 2 is fixed to a winding jig in a state that the connector 2 is moved on a side of a longitudinal axis 100, 100 of the bobbin 1 from the rotating shaft 2*a* of the connector. After initially turning a wire around the connecting portion 3*a* of the terminal 3, the coil wire is wound to have a predetermined number of turns. Thereafter, the coil wire is further turned around the connecting portion 4*a* of the other terminal 4, and a jointed portion is finally soldered up or welded to secure an electrical connection. The nozzle 6 is set to be in a direction perpendicular to the core 1*b* to control tension of the wire at time of winding.

After completing to wind, as illustrated in FIG. 8, the connector 2 is moved in a direction perpendicular to the fixed axis of the bobbin 1 from the rotating shaft 2*a* of the connector; and the connector 2 is fixed by thermally caulking the protrusion for thermally caulking 1*d* of the bobbin 1.

According to Embodiment 1, although the number of components is increased than in the conventional technique even though a shape of the connector 2 is changed, a position of the nozzle 6 is not changed at time of winding; tension can be easily controlled; and an yield in a process can be improved. Further, because a space for the nozzle 6, which space is conventionally necessitated, can be abolished, it is possible to miniaturize the coil bobbin.

Further, because a shape of the connector is variously changed by substituting minimum components, there is an advantage that an efficiency of winding is not deteriorated irrespective of the shape of the connector.

Embodiment 2

Figure 9:
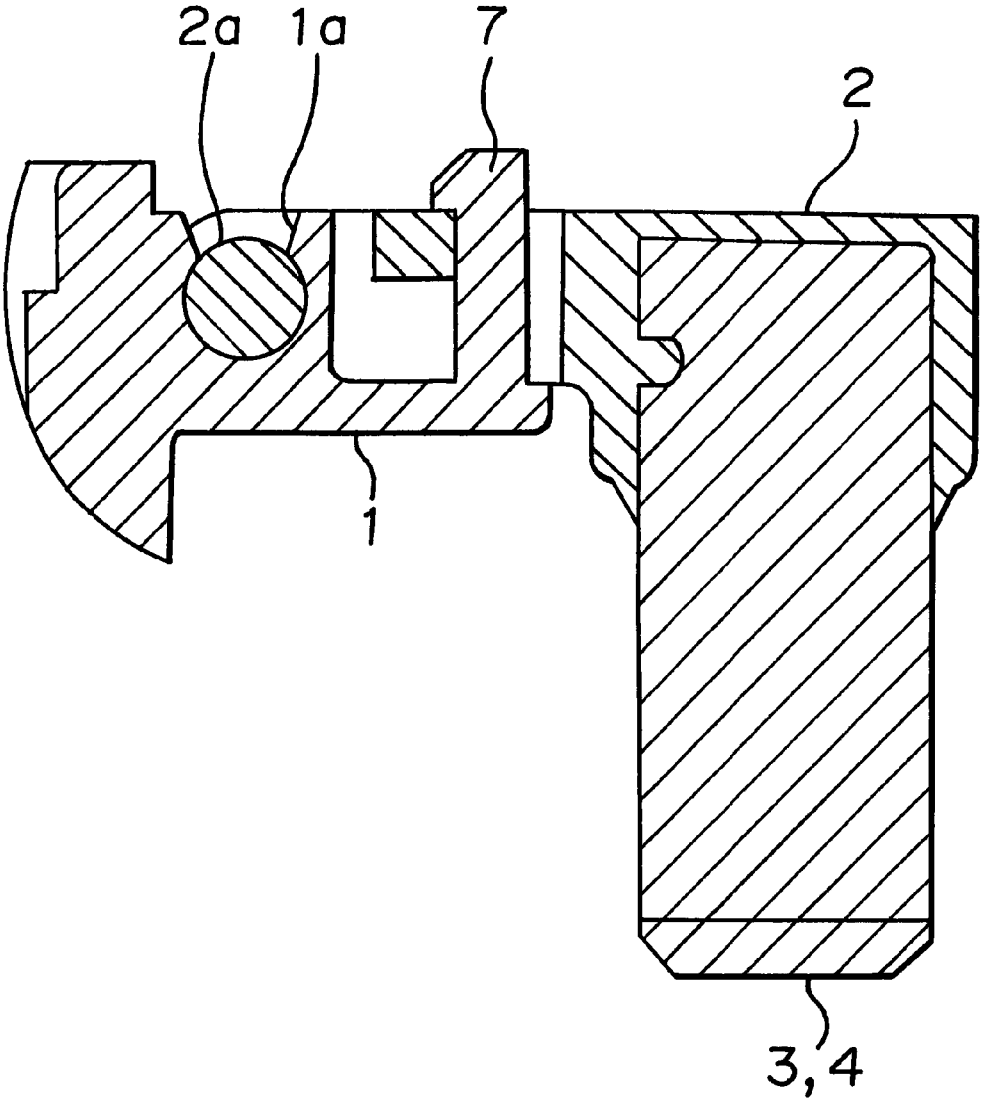
FIG. 9 is a front view schematically illustrating a coil bobbin according to Embodiment 2 of the present invention in section.
Figure 10:
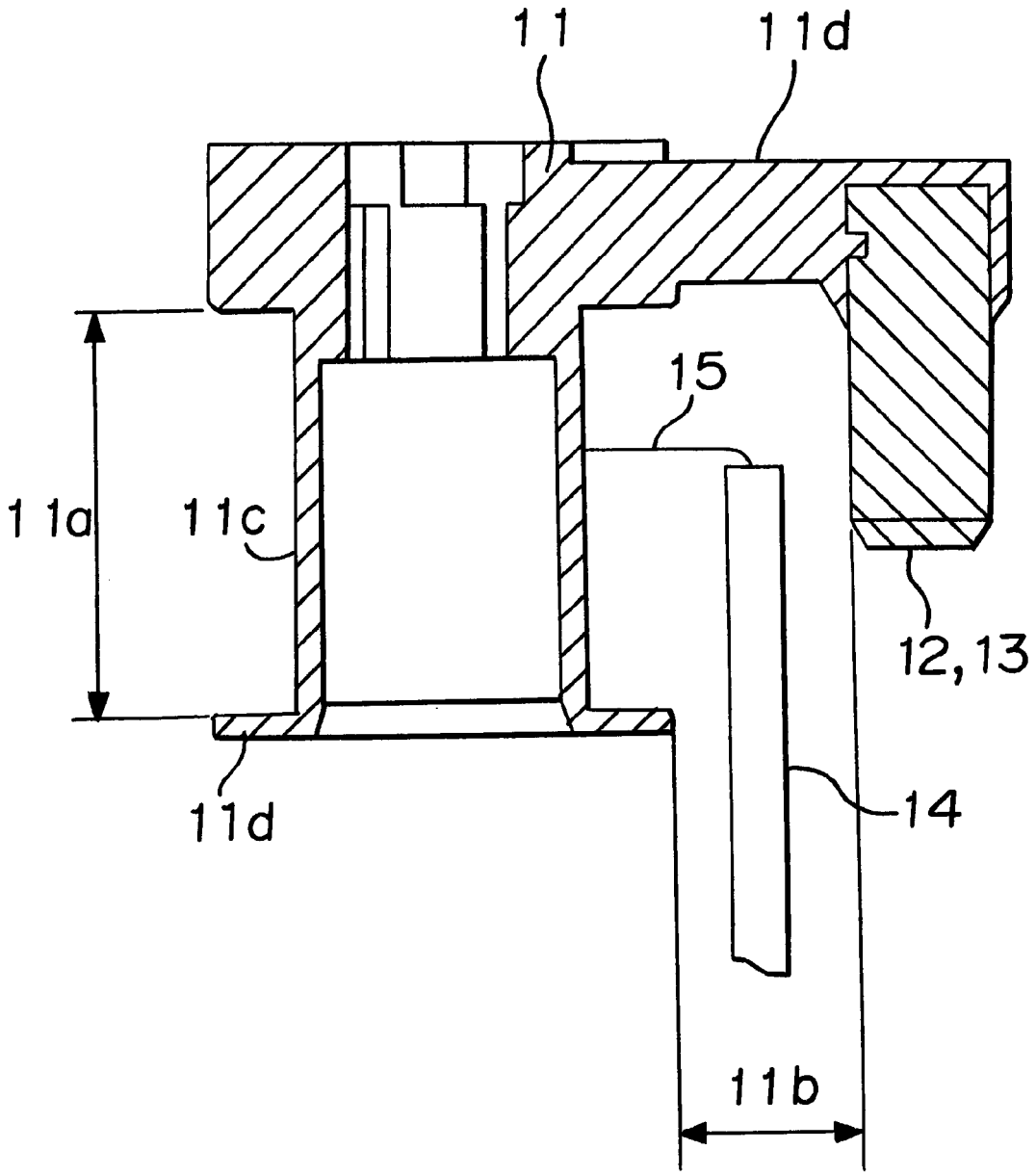
FIG. 10 is a front view illustrating a conventional coil bobbin in section.

Although a case that the connector 2 is fixed by the protrusion for thermally caulking 1*d* has been described in Embodiment 1, it is possible to fix by a hook for fixing 7 as illustrated in FIG. 9.

A first advantage of the coil bobbin according to the present invention is that, because the connector having the terminal, to which the coil is connected, are detachably attached to the bobbin having the core, around which the coil is wound, it is possible to adapt the coil bobbin to various connectors by changing only the connector.

A second advantage of the coil bobbin according to the present invention is that, it is possible to facilitate a control of tension and to improve an yield in a process without changing a position of the nozzle at time of winding.

A third advantage of a coil bobbin according to the present invention is that, looseness of the coil can be avoided at time of rotating the connector.

A fourth advantage of a coil bobbin according to the present invention is that the connector is securely fixed to the bobbin.

Obviously, numerous modifications and variations of the present invention are possible in light of the above teachings. It is therefore to be understood that within the scope of the appended claims, the invention may be practiced otherwise than as specifically described herein.

What is claimed is:

1. A coil bobbin comprising:

a bobbin having a core, around which a coil is wound; and a connector having a terminal, with which said coil is connected, said connector being detachably coupled to said bobbin, wherein said bobbin is joined to said connector by engagement of a supporting hook formed in said bobbin with a rotating shaft formed in said connector, and at a time of winding said coil, said connector is movable in a direction of a longitudinal axis of said bobbin, and after completing the winding of said coil, said connector is movable in a direction perpendicular to the longitudinal axis of said bobbin.

2. The coil bobbin according to claim 1, wherein a portion of said connector, which portion is connected to said coil, and said rotating shaft of said connector are coaxially arranged.

3. The coil bobbin according to claim 2, wherein said bobbin includes a protrusion for thermally caulking, by which said connector is fixed to said bobbin.

4. The coil bobbin according to claim 2, wherein said bobbin includes a hook for fixing said connector to said bobbin.

5. The coil bobbin according to claim 1, wherein said bobbin includes a protrusion for thermally caulking, by which said connector is fixed to said bobbin.

6. The coil bobbin according to claim 1, wherein said bobbin includes a hook for fixing said connector to said bobbin.

* * * * *